US008547030B2

(12) United States Patent
Trattler et al.

(10) Patent No.: US 8,547,030 B2
(45) Date of Patent: Oct. 1, 2013

(54) CURRENT SOURCE, CURRENT SOURCE ARRANGEMENT AND THEIR USE

(75) Inventors: Peter Trattler, Graz (AT); Stefan Wiegele, Graz (AT); Manfred Pauritsch, Graz (AT)

(73) Assignee: AMS AG, Unterpremstaetten (AT)

( * ) Notice: Subject to any disclaimer, the term of this patent is extended or adjusted under 35 U.S.C. 154(b) by 324 days.

(21) Appl. No.: 13/021,303

(22) Filed: Feb. 4, 2011

(65) Prior Publication Data

US 2011/0199008 A1 Aug. 18, 2011

(30) Foreign Application Priority Data

Feb. 4, 2010 (DE) ..... 10 2010 006 865

(51) Int. Cl.
*H05B 37/02* (2006.01)

(52) U.S. Cl.
USPC ..... 315/209 R; 315/308

(58) Field of Classification Search
USPC ..... 315/209 R, 291, 299, 307, 308
See application file for complete search history.

(56) References Cited

U.S. PATENT DOCUMENTS

| | | | | |
|---|---|---|---|---|
| 4,237,405 | A | 12/1980 | Kellis | |
| 4,302,726 | A * | 11/1981 | Shobbrook | 330/260 |
| 5,025,204 | A * | 6/1991 | Su | 323/274 |
| 6,091,614 | A | 7/2000 | Malenfant | |
| 6,160,354 | A | 12/2000 | Ruvinskiy et al. | |
| 6,320,330 | B1 | 11/2001 | Haavisto et al. | |
| 6,586,890 | B2 | 7/2003 | Min et al. | |
| 6,864,867 | B2 | 3/2005 | Biebl | |
| 6,949,892 | B2 | 9/2005 | Horiuchi et al. | |
| 7,262,582 | B2 | 8/2007 | Warita et al. | |
| 7,276,861 | B1 | 10/2007 | Shteynberg et al. | |
| 7,456,586 | B2 * | 11/2008 | Morejon | 315/247 |
| 7,511,436 | B2 | 3/2009 | Xu | |
| 7,622,871 | B2 | 11/2009 | Awalt et al. | |
| 7,839,097 | B2 * | 11/2010 | Chen et al. | 315/291 |
| 2002/0047642 | A1 | 4/2002 | Miyagawa | |
| 2002/0140380 | A1 | 10/2002 | Biebl | |

(Continued)

FOREIGN PATENT DOCUMENTS

| | | |
|---|---|---|
| DE | 44 43 469 | 6/1996 |
| DE | 198 41 270 | 3/2000 |

(Continued)

OTHER PUBLICATIONS

P. Allen et al., "CMOS Analog Circuit Design", Oxford University Press, 2002, p. 475.

(Continued)

*Primary Examiner* — Thuy Vinh Tran
(74) *Attorney, Agent, or Firm* — McDermott Will & Emery LLP

(57) ABSTRACT

A current source (10), comprising a bipolar transistor (1) including a control terminal and a controlled path, a first terminal on the controlled path, to which first terminal an electrical load (D1, D2) may be connected, a second terminal on the controlled path, which second terminal may be connected to a reference potential via a resistor (4), a measuring device (2) coupled to the control terminal for measuring a control current on the control terminal, a compensation device (3) coupled to the measuring device (2) and the bipolar transistor (1) in such a manner that the control current of the bipolar transistor (1) is compensated for at the first terminal of the controlled path.

10 Claims, 5 Drawing Sheets

(56) References Cited

U.S. PATENT DOCUMENTS

| | | | | |
|---|---|---|---|---|
| 2004/0124889 | A1 | 7/2004 | Koharagi et al. | |
| 2004/0263094 | A1 | 12/2004 | Lister | |
| 2005/0088207 | A1 | 4/2005 | Rader et al. | |
| 2006/0022652 | A1* | 2/2006 | Nishimura et al. | 323/280 |
| 2006/0119291 | A1 | 6/2006 | Hung et al. | |
| 2006/0202637 | A1* | 9/2006 | Chiang et al. | 315/291 |
| 2009/0212717 | A1 | 8/2009 | Trattler | |
| 2011/0163771 | A1 | 7/2011 | Kojima et al. | |

FOREIGN PATENT DOCUMENTS

| | | | |
|---|---|---|---|
| DE | 103 18 780 | | 12/2004 |
| EP | 0 542 480 | | 11/1992 |
| EP | 1 447 950 | | 2/2003 |
| EP | 1 499 165 | | 6/2004 |
| JP | 6-22817 | | 3/1994 |
| JP | 10-135747 | | 5/1998 |
| JP | 11-133068 | | 5/1999 |
| JP | 11-215811 | A | 8/1999 |
| JP | 2000-347613 | | 12/2000 |
| JP | 2001-067132 | A | 3/2001 |
| JP | 2001-286605 | | 10/2001 |
| JP | 2002-8409 | | 1/2002 |
| JP | 2002-108464 | | 4/2002 |
| JP | 2003-114306 | | 4/2003 |
| JP | 2003-158300 | | 5/2003 |
| JP | 2003-234625 | | 8/2003 |
| JP | 2003-332624 | | 11/2003 |
| JP | 2005-11895 | | 1/2005 |
| JP | 2005-33853 | | 2/2005 |
| JP | 2005-160241 | A | 6/2005 |
| JP | 2005-537669 | A | 12/2005 |
| JP | 2006-278304 | | 10/2006 |
| WO | WO 2004/021744 | | 3/2004 |
| WO | WO 2006/136321 | | 12/2006 |
| WO | WO 2009/157126 | | 12/2009 |

OTHER PUBLICATIONS

B.S. Song, "A Precision Curvature-Compensated CMOS Bandgap Reference", IEEE Journal of Solid-State Circuits, vol. 18, No. 6, pp. 634-643, Dec. 1983.

U. Tietze et al., "Halbleiterschaltungstechnik", pp. 821-823, English Equivalent: "Electronic Circuits", 2nd Edition, pp. 772-775, Springer Verlag (1999).

* cited by examiner

CURRENT SOURCE, CURRENT SOURCE ARRANGEMENT AND THEIR USE

RELATED APPLICATIONS

This application claims the priority of German patent application no. 10 2010 006 865.9 filed Feb. 4, 2010, the entire content of which is hereby incorporated by reference.

FIELD OF THE INVENTION

The present invention relates to a current source, a current source arrangement comprising a plurality of current sources of this type and to the use of the current source arrangement.

BACKGROUND OF THE INVENTION

In numerous applications in the electronic domain, current sources are required to drive electrical loads. For example, such current sources may be connectable in series with an electrical load, this series connection in turn being supplied by a voltage regulator. Here, the current source serves for precisely adjusting the current level for the electrical load.

Such precise current sources are used, for example, for driving lighting means, in particular light-emitting diodes (LEDs). For this purpose, the electrical load in the load branch to be connected to the voltage regulator may be connected in series with the controlled path of a transistor and with a resistor. In this arrangement, the transistor and the resistor are included in the current source.

Realizing the current source in integrated circuit technology is desired in many cases. Conventionally, a unipolar transistor such as a MOSFET (metal oxide semiconductor field effect transistor) is required for the power element to achieve the desired accuracy. The unipolar transistor is distinguished in that the level of the load current in the controlled path is adjusted by means of the potential on the gate electrode, which is thus possible in exact fashion. The drain and source currents are equal by definition.

This is why a bipolar transistor cannot be used there, because the base current does not allow an exact adjustment of the current on the collector, i.e. of the load current, when the transistor is interconnected in emitter configuration.

SUMMARY OF THE INVENTION

It is one object of the invention to provide a current source which allows providing an exact load current and can do without a power element in MOS technology. Another object of the invention is to provide a current source arrangement comprising a plurality of current sources as well as a use of the current source arrangement.

In one embodiment, a current source comprises a bipolar transistor including a control terminal and a controlled path. An electrical load may be connected to a first terminal of the controlled path. A resistor may be connected to a second terminal of the controlled path and coupled to a reference potential. Further, a measuring device is provided which is coupled to the control terminal of the bipolar transistor for measuring a control current flowing through the control terminal of the bipolar transistor. A compensation device is coupled to the measuring device. The compensation device is further coupled to the bipolar transistor in such a manner that the control current of the bipolar transistor is compensated for at the first terminal of the controlled path.

Due to the compensation of the control current on the load side of the bipolar transistor, it is possible to provide a current source comprising a bipolar transistor which offers high accuracy.

In one embodiment, the compensation device feeds the compensation current to the first or second terminal of the controlled path of the bipolar transistor.

Alternatively, it is also possible to alter the control current by means of the compensation current. The aim is to provide a load current, which preferably is the current on the second terminal of the controlled path, by which an electrical load to be connected may be driven and which is independent of the base current.

The suggested principle is capable of achieving the same accuracy as in case of using a MOSFET for the transistor of the current source. The proposed bipolar transistor, however, in particular with high load currents, is distinguished by considerable cost advantages compared to field effect transistors.

The cost advantage is noticeable with particular benefit where high-voltage processes are required for manufacturing the current source. A high-voltage bipolar transistor may be produced in a much more cost-efficient manner than a high-voltage field effect transistor. Here, a high-voltage technology is to be understood as any kind of technology which in integrated circuit technology allows higher nominal voltages than a standard process, the latter usually being designed for rated voltages of one or few Volt.

In one embodiment, a comparator is provided which comprises a first input which may be fed with a reference voltage, and a second input connected to the second terminal of the controlled path. An output of the comparator is coupled to the control terminal of the bipolar transistor. With the proposed interconnection, the comparator and the reference voltage allow providing a load current which may be exactly adjusted as a function of the reference voltage. In addition, the load current depends on the size of the resistor on the second terminal.

In one embodiment, the compensation device is inserted between a reference voltage source providing the reference voltage for the comparator and the first input of the comparator and connected to the measuring device. This design slightly alters the reference voltage on the first input of the comparator as a function of a signal provided by the measuring device in such a way that exactly the error induced by the base current on the load side of the bipolar transistor is compensated for. To this end, an additional current source is not required.

The comparator is preferably implemented as an operation amplifier.

In one embodiment, a voltage is provided which corresponds to the product of the resistance across the second terminal and the control current. This voltage is added to the reference voltage and fed to the first input of the comparator.

In this alternative of the compensation of the control currents on the base, which also may be referred to as base current if the bipolar transistor is interconnected in emitter or collector configuration, there is no direct intervention on the current in the load branch. The term "load branch" is to be understood as a current branch which comprises the electrical load, the controlled path of the bipolar transistor, and the resistance on the second terminal. This load branch may be inserted between a supply voltage and a reference potential terminal. The supply voltage may be provided by a DC voltage regulator, for instance.

In emitter or collector configuration, the controlled path of the bipolar transistor is formed between the emitter and the collector of the transistor.

In a preferred embodiment, the compensation device is implemented as a compensation current source. In this case, the compensation current source is coupled to one of the two terminals of the controlled path of the bipolar transistor. The emitter current is superimposed by a compensation current, for example.

In one embodiment, the compensation current source is coupled to the second terminal of the controlled path of the bipolar transistor.

The compensation current source may be connected in parallel to the resistor, thus in one embodiment between the second terminal of the controlled path and a reference potential terminal.

Alternatively, the compensation current source may also be connected to the first terminal of the controlled path of the bipolar transistor. In case of an electrical load in the form of one or a plurality of LEDs, this means that the compensation current source is connected to the cathode terminal of the transistor-side LED.

Without the compensation current source, the load current on the first terminal of the controlled path is calculated according to:

$$ILAST=VI/RI-IBASIS,$$

wherein ILAST is the load current on the second terminal of the controlled path, VI is the reference voltage, RI is the value of the resistor and IBASIS is the control current of the bipolar transistor.

If the compensation current ISUB, which in this embodiment is equal to the control current IBASIS, is added to the second terminal of the controlled path of the bipolar transistor, the load current exactly results in $$ILAST=VI/RI.$$

It can be seen that the load current is completely independent of the control current of the bipolar transistor.

In one embodiment, the control terminal of the bipolar transistor is a base terminal, the first terminal of the controlled path is the collector terminal and the second terminal of the controlled path is the emitter terminal of the transistor.

The definition of the reference voltage VI and of the resistor RI permits a highly precise adjustment of the load current.

In order to ensure that the compensation current source provides a compensation current which is exactly equal to the base current or corresponds to it in an exact, pre-definable ratio, a current mirror may be used, for example.

In one embodiment, a first current mirror is provided which comprises the measuring device, and an additional current mirror which comprises the compensation current source. It is preferred that these current mirrors are coupled to each other.

In the case of a comparator having an output stage designed in differential construction, e.g. in the context of a differential operation amplifier, it may be useful to design the input stage of that current mirror which comprises the measuring device likewise in differential construction, too. Thus, the control current of the bipolar transistor may be exactly mirrored out with a correspondingly mirrored output stage of the comparator. Then again, the current may be mirrored into the compensation current source with an additional current mirror.

In one embodiment, both current mirrors have an inversely proportional transmission ratio, the first current mirror 1:N and the second current mirror 1:N, for example.

This allows to achieve savings in terms of current and surface area without renouncing accuracy.

In a further embodiment, the measuring device is implemented with a series resistor instead of a current mirror. Tapping the voltage difference across the resistor results in a conversion of the current to be measured into a measuring voltage. This measuring voltage in turn is supplied to the control input of a compensation current source which, in an advantageous embodiment, comprises a transistor having a compensation resistor connected in series thereto. In an advantageous embodiment, the series resistor of the measuring device and the resistor of the compensation current source exhibit the same resistivity.

In one embodiment, a current source arrangement is provided which comprises a plurality of the current sources described above. The current source arrangement includes a voltage regulator comprising an input for supplying a voltage from a voltage source and further has a common return input for supplying a return voltage. One output delivers a supply voltage which is provided as a function of the return voltage and supplied by the voltage source.

A first one of the described current sources has its first terminal of the controlled path of the bipolar transistor connected to the output of the voltage regulator via an electrical load. At least one further current source, likewise at its first terminal of its controlled path, is connected to the output of the voltage regulator via an additional electrical load.

Optionally, the electrical load is comprised in the current source arrangement (preferably realized in integrated design) or not; in the latter case, the electrical load may be connected to the respective current source from outside.

The first terminal of the controlled path of the current source is coupled to the common return input of the voltage regulator in each case. The common return line allows a simple circuit structure while offering good efficiency of the power supply for a plurality of electrical loads.

In the event that a voltage drop across one of the current sources is too small, the return voltage on the common return input is pulled down. Consequently, the common return input of the DC voltage regulator is also pulled down. The voltage regulator compensates that by an increase of its output voltage in order to obtain the correct return voltage on the return input again.

As there are several current sources, the common return line will be pulled down if any of the connected current sources exhibits a voltage drop which is too small. Thus, the common return input of the voltage regulator is also pulled down, which is compensated for by the DC voltage regulator by increasing the supply voltage at its output until the voltage on the return input again corresponds to the desired set value.

The proposed current source arrangement may be realized in a simple manner and so as to be of small structural shape. Moreover, it may be expanded in easy way, cascaded and also configured in almost any fashion.

Any number of current sources may be added without the need of additional current circuits, even across different semiconductor chips. Only a single line is required between several current sources, namely the signal line which is referred to as common return line here and carries the return voltage.

In the event that several different load types are to be driven, e.g. LEDs of different types (required in RGB applications, for instance), for example red, green and blue LEDs, the current sources preferably may be arranged in groups in such a manner that a common signal line as described above is provided for each of the load types.

In one embodiment, a first input of a comparator is connected to the first terminal of the controlled path of the current source in each case, and the comparator's second input may be fed with a reference threshold. One transistor each is provided which has a control terminal connected to an output of the comparator and in which a terminal of the controlled path is connected to the common return input of the voltage regulator. The reference thresholds may be identical or different.

The comparator may be implemented as an operation amplifier.

The electrical loads each may comprise at least one light-emitting diode or a series connection of light-emitting diodes.

Further embodiments of current source arrangements, which may be combined with the present current sources, are described in DE 10 2005 028 403 A1, filed on Jun. 20, 2005. In this respect, reference is made to DE 10 2005 028 403 A1 in the present application to its full extent.

The current source arrangement may be preferably used for the power supply of light-emitting diodes or for background lighting in a display device by means of white or RGB light-emitting diodes.

The suggested principle shows its advantages exactly in applications of this type. The common return line as well as the high accuracy and the good matching allow operating a multitude of electrical loads in concurrent manner, as it is required, for instance, in background lighting of display devices comprising LEDs, so-called LED backlights. These are preferably used in TV sets and monitors as well as in displays of mobile devices.

In another application, one or a plurality of current source arrangements are provided for the power supply of light-emitting diodes for background lighting in a TV set. This is also referred to as TV backlight.

The proposed principle, however, is not limited to such applications, but may also be applied with advantage in other applications depending on the use.

BRIEF DESCRIPTION OF THE DRAWINGS

The invention will be explained below in more detail on the basis of several exemplary embodiments with the aid of drawings.

DETAILED DESCRIPTION OF THE DRAWINGS

Figure 1:
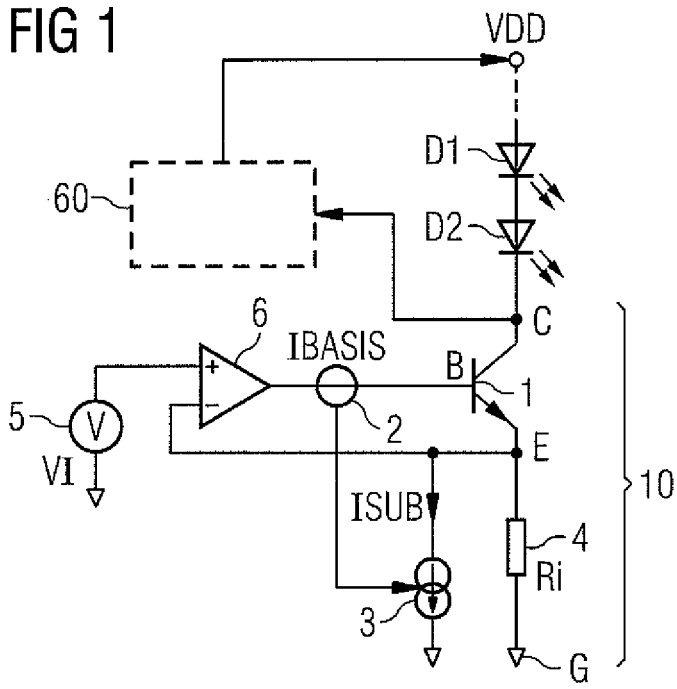
FIG. 1 shows a first exemplary embodiment of a current source including a compensation current source.

FIG. 1 shows a current source 10 comprising a bipolar transistor 1, a measuring device 2, a compensation device implemented as a compensation current source 3, as well as a resistor 4. A reference voltage source 5 and a comparator 6 are provided as well. The comparator may be implemented as an operation amplifier.

The bipolar transistor 1 comprises a control terminal implemented as base terminal B, a first terminal of the controlled path implemented as collector terminal C, and a second terminal of the controlled path implemented as emitter terminal E. An electrical load D1, D2 comprising a series connection of one or a plurality of diodes may be connected to the collector terminal C. The electrical load D1, D2 is inserted between a supply voltage terminal VDD and the collector terminal C. The resistor 4 with the resistivity value RI is connected to the emitter terminal E and pulled to reference potential G.

Apart from the current source 10, FIG. 1 shows the electrical load D1, D2 already mentioned as well as a voltage regulator 60. The collector terminal C is coupled to a return input of the voltage regulator 60, the latter providing a supply voltage for the electrical load on the supply voltage terminal VDD. A voltage source supplying the voltage regulator 60 is not shown. Voltage regulator 60 is shown in broken lines to indicate that it can be on a separate chip from one which carries the other depicted components. This voltage regulator can be any voltage regulator suitable for supplying LEDs and having a feedback input. A preferred embodiment for the voltage regulator is disclosed in commonly assigned co-pending application Ser. No. 11/922,832, the content of which is hereby incorporated by reference.

The measuring device 2 is inserted between the output of the comparator 6 and the base terminal B of the bipolar transistor. The measuring device 2 is connected to a control input of the compensation current source 3 which for its part, at the load side, is connected in parallel to the resistor 4 between the emitter and the reference potential. Further, the comparator 6 comprises a first, non-inverting input connected to a reference voltage source 5. The reference voltage source 5 provides the reference voltage VI. The second input of the comparator 6, operating in an inverting manner, is connected to the emitter terminal of the bipolar transistor 1.

The present embodiment allows providing an exact load current for the electrical load D1, D2 at the collector terminal C. The level of the load current of the current source 10 can be adjusted by the reference voltage VI.

Conventionally, the base current would distort the output current on the load. In this case, the output current would be defined as (LAST=VI/RI−IBASIS.

However, as the compensation current ISUB is added to the emitter side in the present case, the load current at the collector side exactly results in ILAST=VI/RI. Thus, the base current will be precisely eliminated on the load side. Accordingly, the proposed circuit comprising a bipolar transistor offers the same precision as conventionally achievable only with field effect transistors with controlled potential.

Further, the bipolar transistor may be manufactured in a bipolar process in a less expensive way than a correspondingly dimensioned field effect transistor, which is of advantage in particular in high-voltage applications and the associated high-voltage processes in the production of integrated circuits or available discrete transistors.

Figure 2:
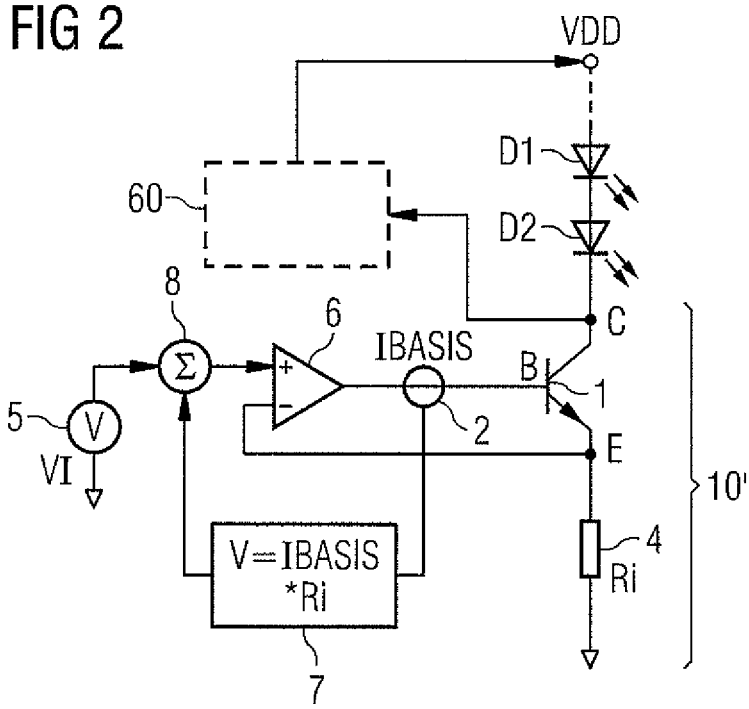
FIG. 2 shows another embodiment of a current source with compensation of the reference voltage.

Instead of the compensation current source 3 engaging the load side, a compensation on the reference input of the comparator 6 is provided in FIG. 2. The exemplary embodiment of FIG. 2 broadly corresponds to that of FIG. 1 and will not be described again.

The compensation current source 3 is dispensed with in FIG. 2. Instead, the output of the measuring device 2 is coupled to a summing node 8 via a multiplying element 7. The summing node 8 is inserted between the reference voltage source 5 and the first input of the comparator 6. The multiplying element 7 provides a voltage calculated from the control current multiplied with the value of the resistor RI. This voltage is superimposed to the reference voltage VI and hence preset for the comparator 6 as a set value. The positive reference voltage of the comparator 6 implemented as an operation amplifier is thus slightly altered compared to FIG. 1. The additional voltage of the multiplying element 7 is calculated such that the slip induced by the control current is exactly compensated for on the load side on collector C.

Compared to FIG. 1, FIG. 2 has the advantage that no additional compensation current source, i.e. no additional power component is needed for the purpose of compensation.

Figure 3:
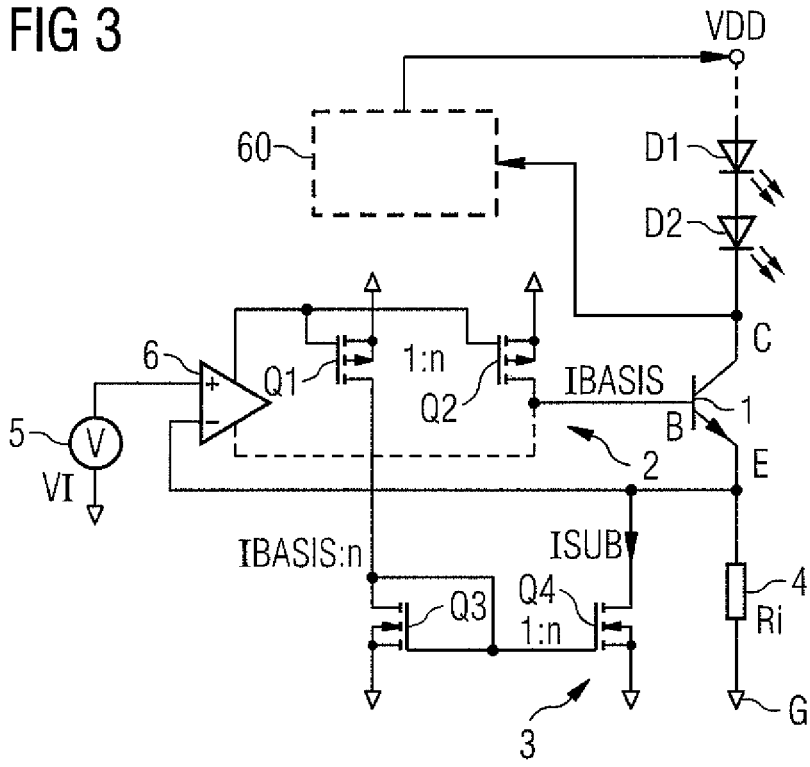
FIG. 3 shows a further development of the embodiment of FIG. 3 by means of an example comprising current mirrors.

FIG. 3 shows a further development of the exemplary current source of FIG. 1, which largely correspond regarding the components used and the advantageous function. In this respect, the description is not repeated here.

In deviation from FIG. 1, the embodiment according to FIG. 3 provides for two current mirrors Q1, Q2; Q3, Q4 by means of which the measuring device 2 as well as the compensation current source 3 are realized. Specifically, a current mirror transistor Q2 is inserted between an output of the comparator 6 and the base terminal of the bipolar transistor in a first current mirror Q1, Q2, with the gate terminal being connected to the output of the comparator 6 when realized in field effect technology. A source-drain terminal of the current mirror transistors Q2 is connected to the base, the other one is pulled to a supply potential. This transistor Q2 of the current mirror, which may also be regarded as the input side of the current mirror, may be an output stage of the comparator 6 in one embodiment. On the gate side, a further current mirror transistor Q1 is connected to this transistor and has its controlled path likewise connected to a supply potential of the transistor Q2, on the one hand, and forms an output of the measuring device, on the other hand. The transistor Q1 may be implemented so as to be scaled down with respect to the transistor Q2, and the ratio width-to-length W/L between transistor Q1 and transistor Q2 may be 1:n, for example.

A second current mirror Q3, Q4 is constituted by a transistor Q3 in diode interconnection and an additional transistor Q4. On their gate sides, the transistor Q4 and the transistor Q3 are connected to each other and pulled to reference potential by one source-drain terminal each. The drain terminals of the transistors Q1 and Q3 are connected to each other, while the drain terminal of the transistor Q4 is connected to the emitter E of the bipolar transistor 1. The current mirror Q3, Q4 may have the same transmission ratio as the first current mirror Q1, Q2, i.e. a ratio width-to-length W/L between the transistors Q3 and Q4 of 1:n. This will ensure that the compensation current ISUB on the drain terminal of the transistor Q4 exactly corresponds to the base current, i.e. the control current of the transistor 1. As a consequence, a particularly good match between the compensation current and the base current is ensured, with the additional fact that chip area may be saved and the power consumption is reduced due to the transmission ratio of the current mirrors.

Figure 4:
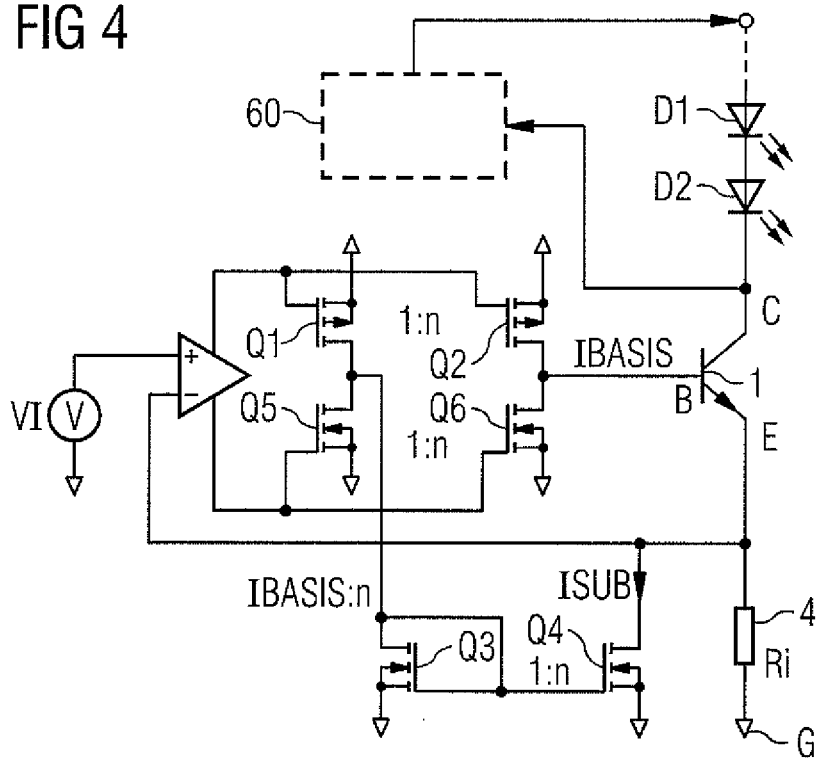
FIG. 4 shows a further development of the embodiment of FIG. 3 by means of the example of a differential output stage of the comparator.

FIG. 4 shows a further development of the embodiment of FIG. 3, in which the output stage of the comparator 6 is implemented in a differential manner, including the transistors Q2 and Q6 constituting a complementary transistor pair of a PMOS and an NMOS transistor. These have their drain sides interconnected in the base terminal of the transistor 1 and their sources sides pulled to a supply potential and reference potential, respectively. In a manner identical to the two transistors Q2, Q6 of the output stage, a decoupling stage is formed with the transistors Q1, Q5, the measuring current being decoupled on the common drain terminal. Apart from the functioning in differential mode, the circuit of FIG. 4 corresponds to that of FIG. 3. The compensation by means of the second current mirror Q3, Q4 is configured as in FIG. 3.

Figure 5:
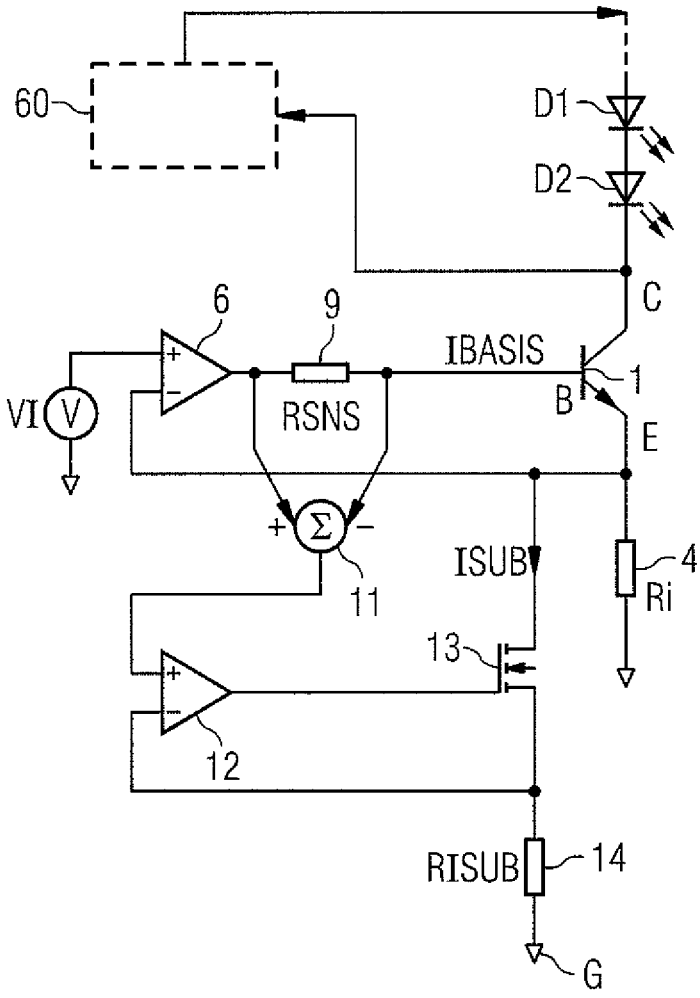
FIG. 5 shows an additional exemplary embodiment including a series resistor for current measurement.

FIG. 5 shows another exemplary embodiment as a modification of the embodiment of FIG. 1, in which the measuring device is realized with a series resistor 9. The series resistor 9 is inserted between the output of the comparator 6 and the base terminal B of the bipolar transistor 1. The voltage difference across the series resistor 9 is determined by means of a subtractor 11 and supplied to a differential amplifier 12 at a non-inverting input. The differential amplifier 12 controls the gate terminal of a transistor 13 of the compensation current source; on the load side, said transistor is connected between the emitter terminal E and, via a compensation resistor 14, a reference potential terminal G. The circuit node between the compensation transistor 13 and the compensation resistor 14 is returned to a negative input of the differential amplifier 12.

This will result in a particularly high accuracy, in particular in case the compensation resistor 14 has the same resistivity as the series resistor 9.

Figure 6:
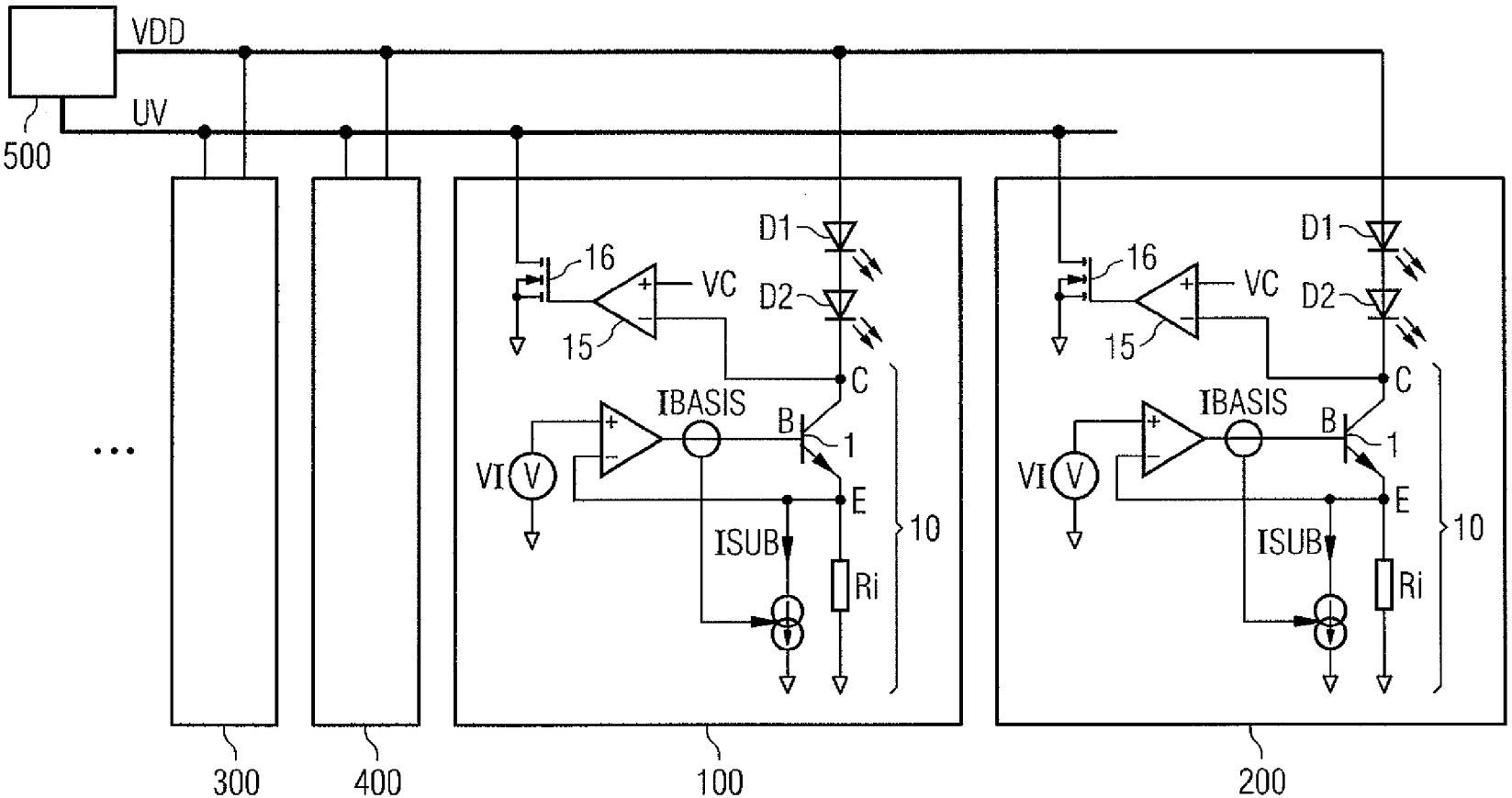
FIG. 6 shows an exemplary embodiment of a current source arrangement comprising a plurality of current sources.

FIG. 6 shows an embodiment of a current source arrangement comprising a plurality of current sources which may be implemented, for instance, as shown in one of the FIGS. 1 to 5. In this example, the current source arrangement comprises a voltage regulator 500 providing a regulated supply voltage VDD. Further, a common return input is provided, which may be supplied with a return voltage UV. The voltage regulator 500 is supplied by a voltage source (not shown). The supply voltage VDD is generated and output as a function of the return voltage UV.

There are provided multiple load channels. The load channels 100, 200, 300, 400 each comprise an electrical load D1, D2. The electrical loads D1, D2 each have one terminal connected to the supply voltage terminal VDD. A further terminal of the electrical load D1, D2 is connected to the collector terminal C of the bipolar transistor 1 of the respective current source 10. In this example, the structure of the current sources 10 within the load channels 100 to 400 is implemented as described in FIG. 1 and is not repeated here. One line extends from the collector terminal C to a comparator 15 in each case and is connected to an inverting input. A non-inverting input of the comparator 15 may be fed with a reference threshold VC whose level may be predefined depending on the type of the electrical load and its electrical characteristics. The output of the comparator 15 is pulled to a control terminal of a transistor 16. On the load side, the transistor 16 of each load channel of the four load channels shown is inserted between a reference potential terminal and the common return input of the voltage regulator.

The common return voltage UV controls the supply voltage on the supply voltage terminal VDD. In case one of the current sources 10 has a voltage which is too low, i.e. a voltage below the respective reference threshold VC, the voltage on the return input is leveled down slightly. This is compensated for by the voltage regulator 500 in that the voltage on the supply voltage terminal VDD is increased until the correct voltage UV is applied to the common return input.

The voltage regulator 500 may be, for instance, an inductive buck, boost, buck/boost controller or a capacitive charge pump. An ordinary series regulator is also possible.

The simple circuit structure allows upgrading with additional load channels, and cascading as well. Any number of current sources may be added, for which no additional circuits are required. An advantageous specialty is that only one line is provided and required, namely the common signal line for mutually coupling the individual current source branches.

Figure 7:
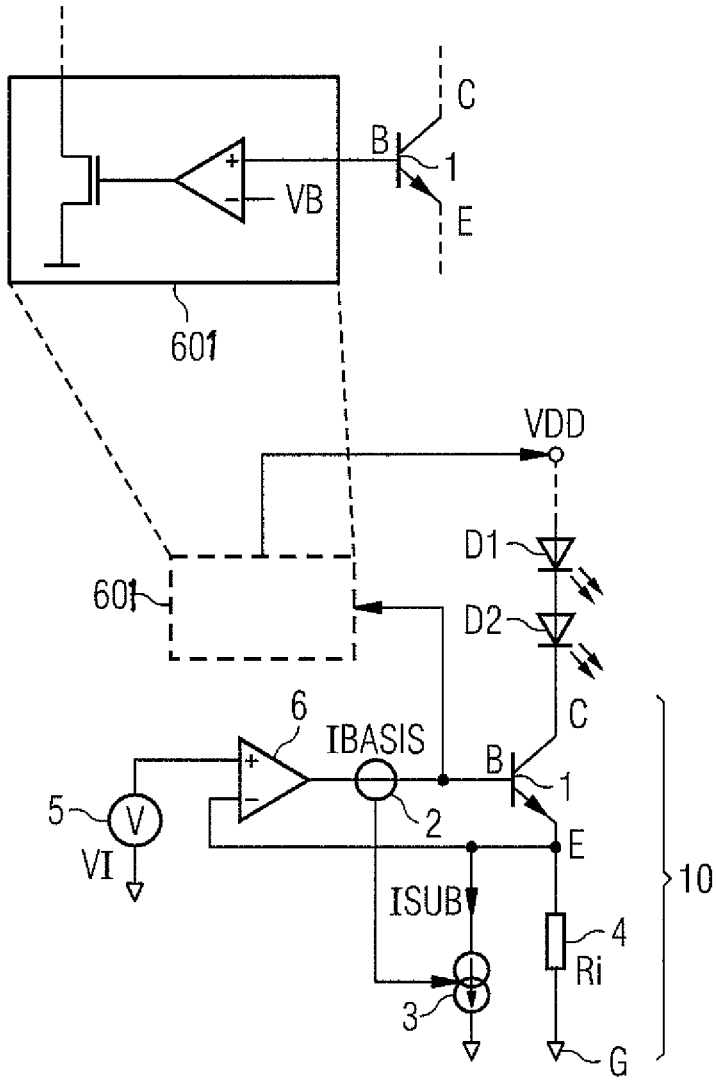
FIG. 7 shows an additional exemplary embodiment of a current source comprising a compensation current source.

FIG. 7 shows an alternative embodiment of the circuit of FIG. 1. The two embodiments according to FIGS. 1 and 7 are mostly identical and in this respect the description is not repeated here. In contrast to FIG. 1, the input of the voltage regulator 601 in FIG. 7 is not connected to the collector terminal C, but to the base terminal B of the bipolar transistor 1.

The input of the voltage regulator 601 is coupled to a comparator at a first input, the second input thereof being fed with a reference threshold VB. The output of the comparator is coupled to a common return line via a transistor, as is shown in FIG. 6. Depending on that, the supply voltage VDD is produced, for instance in a DC/DC converter.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

We claim:

1. A current source, comprising:

a bipolar transistor including a control terminal and a controlled path;

a first terminal on the controlled path adapted to be connected to an electrical load;

a second terminal on the controlled path adapted to be connected to a reference potential via a resistor;

a measuring device coupled to the control terminal for measuring a control current on the control terminal; and a compensation device coupled to the measuring device and the bipolar transistor in such a manner that the control current of the bipolar transistor is compensated for at the first terminal of the controlled path, wherein the compensation device is a compensation current source and the resistor is connected in parallel to the compensation current source.

2. The current source according to claim 1, further comprising:

a comparator having a first input adapted to be fed with a reference voltage, a second input connected to the second terminal of the controlled path, and an output coupled to the control terminal of the bipolar transistor.

3. The current source according to claim 2, wherein the compensation device is inserted between a reference voltage source and the first input of the comparator and connected to the measuring device.

4. The current source according to claim 1, wherein the measuring device and the compensation current source are each realized with a current mirror which are coupled to each other.

5. The current source according to claim 4, wherein the measuring device comprises a current mirror in differential construction.

6. A current source arrangement comprising a plurality of current sources according to claim 1, the current source arrangement comprising:

a voltage regulator comprising a common return input for supplying a return voltage and an output for providing a supply voltage as a function of the return voltage;

wherein one of the plurality of the current sources, at the first terminal of its controlled path, is adapted to be connected to the output of the voltage regulator via an electrical load;

wherein at least one additional current sources from the plurality of current sources, at the first terminal of its controlled path, is adapted to be connected to the output of the voltage regulator via an additional electrical load; and each of the first terminals of the controlled path of the current sources being coupled to the common return input of the voltage regulator.

7. The current source arrangement according to claim 6, wherein a first input of a comparator is connected to the first terminal of the controlled path of the bipolar transistor of the current source in each case, the second input thereof is fed with a reference threshold in each case, wherein one transistor each is provided which has a control terminal connected to an output of the respective comparator, and wherein a terminal of the controlled path is connected to the common return input of the voltage regulator.

8. The current source arrangement according to claim 6, wherein a first input of a comparator is connected to the control terminal of the bipolar transistor of the current source in each case, the second input thereof is adapted to be fed with a reference threshold in each case, wherein one transistor each is provided which has a control terminal connected to an output of the respective comparator, and wherein a terminal of the controlled path is connected to the common return input of the voltage regulator.

9. The current source arrangement according to claim 6, wherein each of the electrical loads comprises at least one light-emitting diode or a series connection of light-emitting diodes.

10. A current source, comprising:

a bipolar transistor including a control terminal and a controlled path;

a first terminal on the controlled path adapted to be connected to an electrical load;

a second terminal on the controlled path adapted to be connected to a reference potential via a resistor;

a measuring device coupled to the control terminal for measuring a control current on the control terminal; and a compensation device coupled to the measuring device and the bipolar transistor in such a manner that the control current of the bipolar transistor is compensated for at the first terminal of the controlled path, wherein the measuring device comprises a series resistor for converting the current to be measured into a measuring voltage.

* * * * *